US011241123B2

(12) United States Patent
Mahaffey et al.

(10) Patent No.: US 11,241,123 B2
(45) Date of Patent: Feb. 8, 2022

(54) PRODUCT USE DETERMINATION SYSTEM

(71) Applicant: Kimberly-Clark Worldwide, Inc., Neenah, WI (US)

(72) Inventors: Cleary E. Mahaffey, Canton, GA (US); Ricky W. Purcell, Dawsonville, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/759,434

(22) PCT Filed: Oct. 31, 2018

(86) PCT No.: PCT/US2018/058569
§ 371 (c)(1),
(2) Date: Apr. 27, 2020

(87) PCT Pub. No.: WO2019/089840
PCT Pub. Date: May 19, 2019

(65) Prior Publication Data

US 2021/0177217 A1 Jun. 17, 2021

Related U.S. Application Data

(60) Provisional application No. 62/579,713, filed on Oct. 31, 2017.

(51) Int. Cl.
*A47K 10/36* (2006.01)
*A47K 10/38* (2006.01)
(Continued)

(52) U.S. Cl.
CPC ..... *A47K 10/3625* (2013.01); *A47K 5/12* (2013.01); *A47K 10/3612* (2013.01);
(Continued)

(58) Field of Classification Search
CPC ..... A47K 10/3625; A47K 10/3612; A47K 10/38; A47K 10/44; A47K 5/12; A47K 2010/3226; A47K 2010/3668
See application file for complete search history.

(56) References Cited

U.S. PATENT DOCUMENTS 6,411,920 B1 * 6/2002 McConnell ..... A47K 10/42 242/564.1
7,530,526 B1 * 5/2009 Powers ..... A47K 10/38 242/422.5
(Continued)

FOREIGN PATENT DOCUMENTS

CN 1809313 A 7/2006
CN 104731048 A 6/2015
(Continued)

*Primary Examiner* — Stanton L Krycinski

(57) ABSTRACT

A dispenser for dispensing consumable product having a consumable product storage area configured to store the consumable product within the dispenser; a dispensing mechanism operatively coupled to the consumable product and configured to facilitate a dispensing cycle to dispense a portion of consumable product, and wherein the dispensing cycle creates a vibration event in at least a portion of the dispenser; a vibration sensing device configured to sense a vibrational characteristic of the vibration event, wherein a value of the vibrational characteristic changes as a function of an amount of consumable product remaining in the dispenser; and a data processing device configured to (i) store data describing the vibrational characteristic and (ii) communicate the data to a remote receiver separate from the dispenser.

10 Claims, 2 Drawing Sheets

(51) Int. Cl.
*A47K 10/44* (2006.01)
*A47K 5/12* (2006.01)
*A47K 10/32* (2006.01)

(52) U.S. Cl.
CPC ..... *A47K 10/38* (2013.01); *A47K 10/44* (2013.01); *A47K 2010/3226* (2013.01); *A47K 2010/3668* (2013.01)

(56) References Cited

U.S. PATENT DOCUMENTS 7,611,030 B2 * 11/2009 Reynolds ..... A47K 5/1217 222/1
7,774,096 B2 * 8/2010 Goerg ..... A47K 10/3845 700/236
8,651,003 B1 * 2/2014 Vercellone ..... A47K 10/3827 83/649
9,999,326 B2 * 6/2018 Borke ..... A47K 10/3656
10,365,139 B2 * 7/2019 Singh ..... H04L 67/12
10,373,477 B1 * 8/2019 Bonner ..... G08B 21/245
10,602,889 B2 * 3/2020 Paul ..... A47K 10/36
2006/0173576 A1 8/2006 Goerg et al.
2010/0286817 A1 11/2010 Goeking et al.
2011/0132955 A1 6/2011 Achton
2012/0260729 A1 10/2012 Bayley et al.
2014/0367401 A1 12/2014 Stralin et al.
2015/0223646 A1 * 8/2015 Wegelin ..... A47K 5/1211 222/1
2016/0309952 A1 10/2016 Van Den Aker et al.
2018/0177348 A1 * 6/2018 Swanson ..... A47K 10/3625

FOREIGN PATENT DOCUMENTS

JP 2003038384 A 2/2003
WO 07068270 A1 6/2007
WO 17032697 A1 3/2017

* cited by examiner

PRODUCT USE DETERMINATION SYSTEM

This application claims priority from U.S. provisional Patent Application Ser. No. 62/579,713 filed on Oct. 31, 2017, the entire contents of which are incorporated herein by reference.

TECHNICAL FIELD

This disclosure generally relates to dispensers for dispensing consumable products.

BACKGROUND OF THE DISCLOSURE

Systems dispensing consumable products are ubiquitous in many environments today. For example, paper hand towel dispensers are commonplace in many private, semi-private and public washrooms, work areas, food processing stations and kitchens. Monitoring and refilling such dispensers can be a time consuming and laborious endeavor requiring, in some scenarios, that an attendant or building maintenance team member routinely check the dispensers and refill as needed. This process inevitably results in checking the dispenser and determining that no refill is required, resulting in an unnecessary visit to the dispenser, which leads to building management inefficiencies and additional costs, or determining that the dispenser has run out of product thereby frustrating users.

SUMMARY OF THE DISCLOSURE

In general, the subject matter of this specification relates to a dispenser, e.g., a paper product dispenser. One aspect of the subject matter described in this specification can be implemented in systems that includes a consumable product storage area configured to store the consumable product within the dispenser; a dispensing mechanism operatively coupled to the consumable product and configured to facilitate a dispensing cycle to dispense a portion of consumable product, and wherein the dispensing cycle creates a vibration event in at least a portion of the dispenser; a vibration sensing device configured to sense a vibrational characteristic of the vibration event, wherein a value of the vibrational characteristic changes as a function of an amount of consumable product remaining in the dispenser; and a data processing device configured to (i) store data describing the vibrational characteristic and (ii) communicate the data to a remote receiver separate from the dispenser. Other embodiments of this aspect include corresponding methods, apparatus, and computer program products.

One aspect of the subject matter described in this specification can be implemented in a method that includes installing a vibration sensing device in an environment having an existing dispenser, wherein the vibration sensing device is configured to sense a vibrational characteristic of a dispensing operation, and wherein a value of the vibrational characteristic changes as a function of an amount of consumable product remaining in the dispenser; monitoring the dispenser to determine low consumable product states for the dispenser based on changes in the value of the vibrational characteristic over time; and generating alert messages in response to determined low consumable product states detecting dispense events based on measurements of the vibrational characteristic; and providing data describing the measurements to a remote receiver. Other embodiments of this aspect include corresponding systems, apparatus, and computer program products.

Particular embodiments of the subject matter described in this specification can be implemented so as to realize one or more of the following advantages. For example, the status of existing dispensers, including the status or state of consumable products in the dispensers (e.g., need to be refilled or at an acceptable level, amount of consumable product remaining, jammed or malfunctioning), can be monitored without having to install new dispensers with integral, dedicated components and functionality because the technology described herein can monitor existing devices based on their intrinsic vibrational characteristics. Thus the technology described herein does not require a costly change-out of existing dispensers to monitor and manage service conditions including product refilling and other maintenance events. For example, this enables dispensers already installed (e.g., mounted to walls or other structures) to be retrofit with this monitoring technology to allow the dispensers to be remotely monitored, e.g., when included with a communication device to transmit the monitored information to a central hub or notify a service attendant.

Further, outside of the retrofit application, new dispensers of different types can include this monitoring technology as it can work on dispensers of all types with the same hardware, which reduces the number and types of monitoring systems that must be customized for each application. For example, a monitoring system for a liquid soap dispenser may "count" the number of motor actuators that cause a dispense and a monitoring system for a rolled paper towel dispenser may measure the diameter or circumference of the paper towel roll to determine how much product is remaining/has been used. The vibrational monitoring described herein can be used on either such dispenser, as well as other types, such that the number of different types of monitoring systems can be reduced, which simplifies manufacturing, the supply chain and can reduce cost.

The details of one or more implementations of the subject matter described in this specification are set forth in the accompanying drawings and the description below. Other features, aspects, and advantages of the subject matter will become apparent from the description, the drawings, and the claims.

Figure 1:
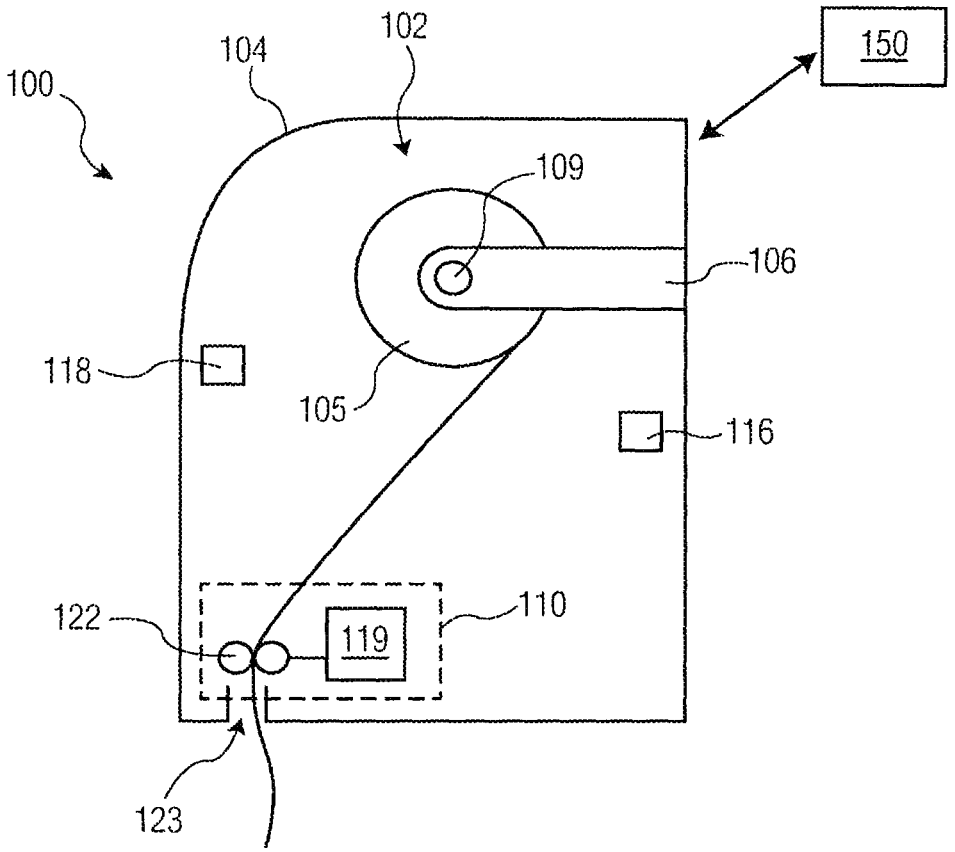
FIG. 1 is a cutaway representation of an example product dispenser.

Repeat use of reference characters in the present specification and drawings is intended to represent the same or analogous features or elements of the disclosure.

DETAILED DESCRIPTION OF THE DISCLOSURE

Figure 2:
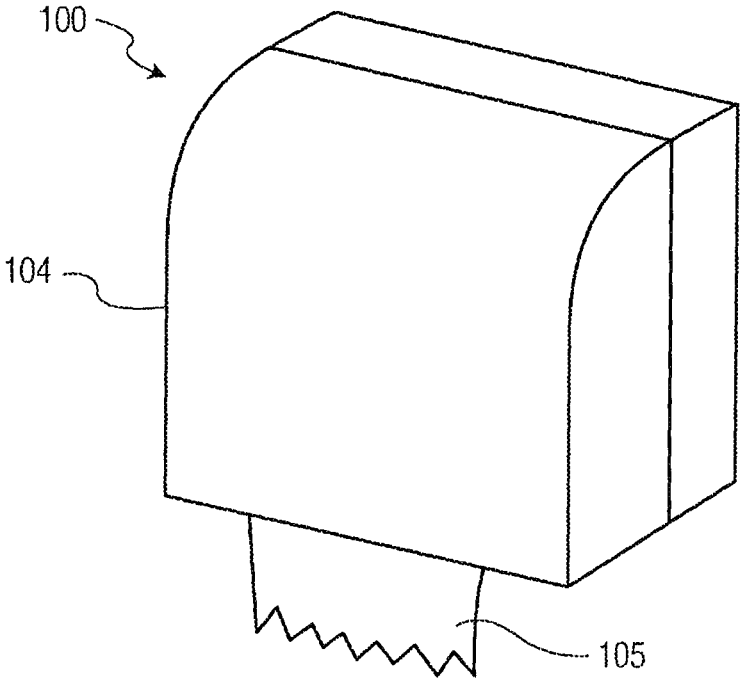
FIG. 2 is a perspective representation of the example product dispenser.

The present disclosure relates to determining dispenser use and, thereby, product consumption in the dispenser based on vibrational characteristics or changes in vibrational characteristics of the dispenser attributable to the amount of product remaining in the dispenser. For example, a paper towel dispenser holding a full roll of paper towels may have a first vibrational characteristic and that same dispenser with the roll half used will have a second, different vibrational characteristic, e.g., as the change in mass of the roll causes a change in the vibrational characteristic. These vibrational characteristic measurements can be made, for example, by an accelerometer. Thus by monitoring changes in the dispenser's vibrational characteristic(s), a prediction or estimate of the amount of product remaining in the dispenser can be constructed. This product level/amount information can be used, for example, to issue a low product alert when the amount of product remaining decreases below a given threshold to avoid the dispenser running out of product or it can be used to determine how much product is remaining in the dispenser at a given time. A dispenser with this functionality is described in more detail below with referenced to FIG. 1, which is a cutaway representation of an example product dispenser 100, and FIG. 2, which is a perspective representation of the example product dispenser 100.

The dispenser 100 can be, for example, a hand towel dispenser 100, bath tissue dispenser 100, liquid soap dispenser, fragrance dispenser or the like. The dispenser 100, more generally, is a device that holds consumable product and dispenses the consumable product in response to a stimulus, e.g., a user or environmental stimulus, or at pre-determined (e.g., programmatically) set intervals. The dispenser 100 includes a body 104 or outer cover or case 104, e.g., a composite, polymeric or metal housing. The outer cover 104 encloses, fully or partially, a product holding area 102 or interior 102 of the dispenser 100. The product holding area 102 holds, for example, the product-to-be-dispensed 105 (e.g., paper towels, bath tissue, wipes/wipers, liquid soap or sanitizer, lotion, deodorizer, etc.) by the dispenser 100 and, in some implementations, one or more electrical or mechanical components used to enable the dispense process such as a motor, batteries, rollers, sensors to determine when a user requests a dispense, etc. In some implementations, the dispenser 100 includes a processing device or apparatus 118. Alternatively if the processing device/apparatus 118 is remote to the dispenser 100, the dispenser can include a transceiver to wirelessly communicate with the processing device 118. The dispenser 100 can be located in, for example, a private, semi-private or public washroom, break room or kitchen, or clean room or other work station area.

The dispenser 100 also includes a dispensing mechanism 110. The dispensing mechanism 110 operates to dispense a portion of the consumable product in the holding area 105 (e.g., dispense a length of roll 105 for use to dry hands). In some implementations, for example, for rolled paper towels or wipers or bath tissue, the dispensing mechanism 110 is an electromechanical feed mechanism that includes or operates in conjunction with a motor 119 that, in response to a stimulus such as a user waving a hand proximate the dispenser 100, feeds a length of the roll through an opening 123 in the body 104 to present to the user. For example, the dispensing mechanism 110 can include a series of rollers 122 through which a portion of the roll is feed such that when the dispensing mechanism 110 actuates it pulls and unwinds the roll (or causes the roll to be pulled and unwound) to feed a portion of the roll 105 to the user. In some implementations, the motor 119 can be integral to the roll holder 106 and causes a spindle 109 of the roll holder 106 (e.g., on which the rolled product is mounted) to turn thereby causing the roll 105 to unwind and be dispensed. In the case, for example, of a liquid soap or sanitizer dispenser 100 the motor 119 may be a pump 119 that draws the liquid product from a bottle, cassette or other container holding the liquid product to use for a dispense operation. In the case of folded towels, the dispenser mechanism 110 is the throat of the dispenser 100, through product is dispensed and by which pressure (e.g., friction) is exerted on the towels as they are pulled through the throat to cause one towel to separate from another to enable single towel dispensing.

In some implementations, the dispenser 100 is a user-driven dispensing unit, e.g., the dispense process is not powered by a motor or other electromechanical generator. For example, for a rolled paper product dispenser 100 such as a paper towel or bath tissue dispenser, a user may grab an exposed tail of the roll 105 and pull to cause more of the product to be dispensed. For a liquid soap or sanitizer dispenser 100, a user may depress or otherwise manually actuate a pump (e.g., dispensing mechanism 110) to draw the product 105 from its container and dispense the product 105.

Regardless of whether the dispensing mechanism 110 is electrically or manually powered (e.g., pulling a tail of the product 105 or pushing a lever or turning a knob), the dispensing cycle to dispense product, which is facilitated by the dispensing mechanism 110, creates a vibration event in at least a portion of the dispenser 100. The vibration event is a mechanical movement or oscillation in or of the dispenser 100 or components of the dispenser (e.g., the body 104, the roll holder 106, the spindle 109 or, in the case of a liquid product, the container or product vessel) whose equilibrium has been disturbed by the dispensing cycle. Vibration events can be described, at least in part, by one or more vibrational characteristics. A vibrational characteristic is a measurable feature or quality of the vibration event. In some implementations, as described below, the vibrational characteristic changes as a function of an amount of consumable product 105 remaining in the dispenser 100. For example, the vibrational characteristic can be acceleration (e.g., in a vertical direction, horizontal direction or combination thereof, g-force), vibration displacement (e.g., the magnitude of the vibrational movement of the dispenser 100), vibration velocity (e.g., the time rate of change of the vibration displacement), vibration frequency (e.g., the occurrence rate of cycles of vibration displacement), and/or vibration damping effect (e.g., a measure of the rate the dispenser returns to a vibrational equilibrium) to name a few.

The dispenser 100 includes a vibration sensing device 116 to sense the vibrational characteristic(s) of the vibration event. In some implementations, the vibration sensing device 116 measures the change or the absolute value of the vibrational characteristic during a vibration event (e.g., dispense cycle) and/or before or after (e.g., which can be programmatically set by an administrator). For example, the vibration sensing device 116 can be an accelerometer 116 and can measure the g-force or more generally the acceleration (and/or another of the above vibrational characteristics) at one or more points in time on or in the dispenser 100 during a dispense cycle. More generally, the vibration sensing device 116 is a device (e.g., a piezoelectric or MEMS device) that is capable of measuring a vibrational characteristic. In some implementations, a disturbance can be intentionally introduced into the dispenser 100 (i.e., some disturbance other than that caused by the dispensing cycle) and the natural or harmonic frequency(ies) of the dispenser 100 can be monitored to observe changes in such frequencies as a function of the amount of product 105 in the dispenser.

Testing has showed that vibrational characteristic values are linked to the amount of product 105 (e.g. mass of the product 105) remaining in the dispenser. For example, for a rolled hand towel dispenser (KIMBERLY-CLARK PROFESSIONAL MOD eHRT hard rolled towel dispenser using SCOTT MOD hard rolled towels (1150')), testing showed that there was a correlation between the g-force (gFz) measured (by the Physics Toolbox Sensor Suite from VIEYRA SOFTWARE running on an APPLE iPhone device placed on a back case of the dispenser 100), during a dispensing cycle, on the body 104 of the dispenser 100 and the mass of the product 105 remaining, as shown below in Table 1 and illustrated in FIG. 3 (with g-force measured in the vertical direction). This data can be curve fit by well-known techniques (e.g., interpolation, nonlinear or linear regression) to determine a mathematical equation to describe the correlation.

TABLE 1

| Mass (grams) | Acceleration (g-Force) |
|---|---|
| 78 | 0.001048 |
| 206 | 0.003151 |
| 327 | 0.002711 |
| 454 | 0.002228 |
| 579 | 0.001879 |
| 712 | 0.002218 |
| 840 | 0.002672 |
| 963 | −0.00068 |
| 1096 | −0.00471 |
| 1221 | −0.00599 |
| 1346 | −0.00592 |
| 1478 | −0.00564 |
| 1607 | −0.00698 |
| 1729 | −0.00909 |
| 2030 | −0.01428 |

Figure 3:
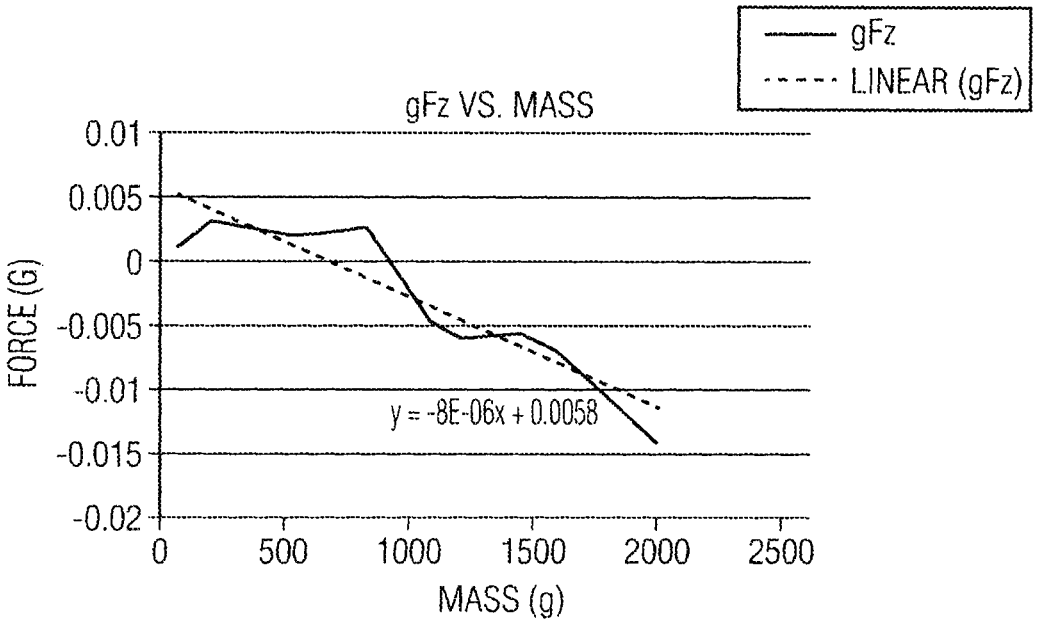
FIG. 3 is a graph showing a force vs. mass function.

As shown in FIG. 3, the equation describing the relationship between vertical g-Force measured on the dispenser 100 and the mass of the product 105 is y=−8E−06x+0.0058 ("Equation 1"). Thus knowing the measured g-Force at a given time and solving for x, the mass of the product 105 remaining at that time can be determined or approximated. This data shows that the measured g-Force (vibrational characteristic) changes as a function of the amount of product 105 remaining. More complex equations could also be used to describe the data relationship shown in Table 1 and FIG. 3 such as a multi-order equation (e.g., quadratic or cubic or higher order equations). Thus non-linear relationships between the vibrational characteristic and product mass are possible and can be characterized by multi-order equations.

For some vibrational characteristics and dispensers 100, the relationship between the characteristic and amount of product remaining may not be linearly proportional, as approximated in Equation 1. For example, the vibrational characteristic may be in a given range until the amount of product decreases below a threshold limit and then the vibrational characteristic will move outside of the range indicating the amount of product remaining is below the threshold limit. Equations or descriptions of the relationships of other vibrational characteristics and dispensers and products can be determined empirically and/or theoretically and stored for later use.

In some implementations, depending on the type and design of the dispenser 100, the position of the vibration sensing device 116 on/in the dispenser 100 or on the product 105 or container dispensing the product (e.g., as for liquid soap applications) can affect the relationship between the measured vibrational characteristic and the amount of product 105 remaining. Thus, in some implementations, a design of experiments may be conducted to determine the preferred location of the vibration sensing device 116 and which vibrational characteristic provides the desired correlation to the amount of product remaining or consumed based on that location.

The dispenser 100 includes a data processing device 118, which stores the data describing the vibrational characteristics and communicates the data to a remote receiver 150 separate from the dispenser 100. The data processing device 118 is in data communication with the vibration sensing device 116 to gather readings from the device 116 (e.g., during vibration events) and store and/or communicate those readings to the remote receiver 150 for processing, e.g., determine the mass of the Product remaining according to Equation 1. More generally, the remote receiver 150 (e.g., a data processing apparatus) can access and use the previously determined equations or descriptions quantifying and/or approximating the relationship between measures or changes of the vibrational characteristic and the amount of product remaining. Once the correct relationship description/equation has been identified, e.g., based on the type (e.g., model number) of dispenser and/or type or format (e.g., large or small roll or 8 or 10 oz. bottle) of product 105 and location of the vibration sensing device 116, the remote receiver 150 uses the vibration sensing device 116 readings and identified description/equation to determine or approximate the amount of product 105 remaining.

In some implementations, the dispenser 100 includes an isolator coupled to the outer case 104, between the dispenser 100 and the surface to which the dispenser 100 is mounted, to provide vibration isolation between the dispenser 100 and the mounting surface. The isolator can be, for example, a rubber pad or spring device that reduces or eliminates extraneous vibrations (e.g., vibrations not emanating from the dispenser 100) from reaching the dispenser 100 and altering the readings/measurements from the vibration sensing device 116. In some implementations an isolator is not used and instead of measuring an absolute value of the vibrational characteristic, differences in the vibrational characteristic are compared over time, where such differences may be mounting surface independent, as opposed to absolute values which may be affected by the mounting surface.

In many cases, a dispenser 100 may already be installed and not have the capability to determine product levels. In these scenarios a vibration sensing device 116 can be added to these already installed dispensers to enable this capability, e.g., along with a transmitter or transceiver to send the use/product level information to, for example, a remote receiver 150. To this end, a vibration sensing device 116 can be placed or installed on an existing dispenser. For example, this can range from adhering or attaching (e.g., through mechanical means such as screws or nuts and bolts) the device 116 to the dispenser at a specific location, e.g., based on the type of dispenser 100 and the selected relationship between the sensing device location and product 105 type, Once installed, the device 116 can detect dispense events based on measurements (or changes) of the vibrational characteristic; and provide data (e.g., either in response to the dispenser or at predetermined intervals) describing the measurements to the remote receiver 150 for processing, as described above.

Embodiments

Embodiment 1. A dispenser for dispensing consumable product comprising: a consumable product storage area configured to store the consumable product within the dispenser; a dispensing mechanism operatively coupled to the consumable product and configured to facilitate a dispensing cycle to dispense a portion of consumable product, and wherein the dispensing cycle creates a vibration event in at least a portion of the dispenser; a vibration sensing device configured to sense a vibrational characteristic of the vibration event, wherein a value of the vibrational characteristic changes as a function of an amount of consumable product remaining in the dispenser; and a data processing device configured to (i) store data describing the vibrational characteristic and (ii) communicate the data to a remote receiver separate from the dispenser.

Embodiment 2. The dispenser of embodiment 1, wherein the vibration sensing device comprises an accelerometer.

Embodiment 3. The dispenser of any preceding embodiment, wherein the vibrational characteristic is a measure of acceleration in a vertical direction of the at least a portion of the dispenser.

Embodiment 4. The dispenser of preceding embodiment 3, wherein the acceleration is g-force.

Embodiment 5. The dispenser of any preceding embodiment, wherein the vibrational characteristic is a measure of vibration displacement in the at least a portion of the dispenser.

Embodiment 6. The dispenser of any preceding embodiment, wherein the vibrational characteristic is a measure of vibration velocity in the at least a portion of the dispenser.

Embodiment 7. The dispenser of any preceding embodiment, wherein the vibrational characteristic is a measure of vibration frequency in the at least a portion of the dispenser.

Embodiment 8. The dispenser of any preceding embodiment, wherein the vibrational characteristic is a measure of vibration damping effect in the at least a portion of the dispenser.

Embodiment 9. The dispenser of any preceding embodiment, comprising an outer case at least partially enclosing the product storage area and wherein the vibration sensing device is coupled to the outer case.

Embodiment 10. The method of embodiment 9, comprising an isolator coupled to the outer case and configured to provide vibration isolation between the dispenser and a wall on which the dispenser is mounted.

Embodiment 11. The method of embodiments 9 or 10, wherein the data processing device comprises a wireless transmitter.

Embodiment 12. A method installing a vibration sensing device in an environment having an existing dispenser, wherein the vibration sensing device is configured to sense a vibrational characteristic of a dispensing operation, and wherein a value of the vibrational characteristic changes as a function of an amount of consumable product remaining in the dispenser; detecting dispense events based on measurements of the vibrational characteristic; and providing data describing the measurements to a remote receiver.

Embodiment 13. The method of embodiment 12, wherein the vibration sensing device comprises an accelerometer.

Embodiment 14. The method of any of embodiments 12-13, wherein the dispenser is a motorized hand towel dispenser for dispensing paper towels from a roll and comprises arms holding the roll, the method comprising placing the vibration sensing device on one of the arms.

Embodiment 15. The method of any of embodiments 12-14, wherein the dispenser is a liquid soap dispenser for dispensing liquid soap and comprises a bottle containing the liquid soap, the method comprising placing the vibration sensing device on the bottle.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices). The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ('LAN') and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a user computer (e.g., for purposes of displaying data to and receiving user input from a user interacting with the user computer). Data generated at the user computer (e.g., a result of the user interaction) can be received from the user computer at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

This written description does not limit the invention to the precise terms set forth. Thus, while the invention has been described in detail with reference to the examples set forth above, those of ordinary skill in the art may affect alterations, modifications and variations to the examples without departing from the scope of the invention.

What is claimed is:

1. A dispenser for dispensing consumable product comprising:

a consumable product storage area configured to store the consumable product within the dispenser;

a dispensing mechanism operatively coupled to the consumable product and configured to facilitate a dispensing cycle to dispense a portion of consumable product, and wherein the dispensing cycle creates a vibration event in at least a portion of the dispenser;

a vibration sensing device comprising an accelerometer configured to sense a vibrational characteristic of the vibration event, wherein a value of the vibrational characteristic changes as a function of an amount of consumable product remaining in the dispenser; and a data processing device configured to store data describing the vibrational characteristic, and wherein the vibrational characteristic comprises a measure of acceleration in a vertical direction of the at least a portion of the dispenser.

2. The dispenser of claim 1, wherein the acceleration is g-force.

3. A dispenser for dispensing consumable product comprising:

a consumable product storage area configured to store the consumable product within the dispenser;

a dispensing mechanism operatively coupled to the consumable product and configured to facilitate a dispensing cycle to dispense a portion of consumable product, and wherein the dispensing cycle creates a vibration event in at least a portion of the dispenser;

a vibration sensing device comprising an accelerometer configured to sense a vibrational characteristic of the vibration event, wherein a value of the vibrational characteristic changes as a function of an amount of consumable product remaining in the dispenser; and a data processing device configured to store data describing the vibrational characteristic, wherein the vibrational characteristic is a measure of vibration displacement in the at least a portion of the dispenser.

4. A dispenser for dispensing consumable product comprising:

a consumable product storage area configured to store the consumable product within the dispenser;

a dispensing mechanism operatively coupled to the consumable product and configured to facilitate a dispensing cycle to dispense a portion of consumable product, and wherein the dispensing cycle creates a vibration event in at least a portion of the dispenser;

a vibration sensing device comprising an accelerometer configured to sense a vibrational characteristic of the vibration event, wherein a value of the vibrational characteristic changes as a function of an amount of consumable product remaining in the dispenser; and a data processing device configured to store data describing the vibrational characteristic, wherein the vibrational characteristic is a measure of vibration velocity in the at least a portion of the dispenser.

5. A dispenser for dispensing consumable product comprising:

a consumable product storage area configured to store the consumable product within the dispenser;

a dispensing mechanism operatively coupled to the consumable product and configured to facilitate a dispensing cycle to dispense a portion of consumable product, and wherein the dispensing cycle creates a vibration event in at least a portion of the dispenser;

a vibration sensing device comprising an accelerometer configured to sense a vibrational characteristic of the vibration event, wherein a value of the vibrational characteristic changes as a function of an amount of consumable product remaining in the dispenser; and a data processing device configured to store data describing the vibrational characteristic, wherein the vibrational characteristic is a measure of vibration frequency in the at least a portion of the dispenser.

6. A dispenser for dispensing consumable product comprising:

a consumable product storage area configured to store the consumable product within the dispenser;

a dispensing mechanism operatively coupled to the consumable product and configured to facilitate a dispensing cycle to dispense a portion of consumable product, and wherein the dispensing cycle creates a vibration event in at least a portion of the dispenser;

a vibration sensing device comprising an accelerometer configured to sense a vibrational characteristic of the vibration event, wherein a value of the vibrational characteristic changes as a function of an amount of consumable product remaining in the dispenser; and a data processing device configured to store data describing the vibrational characteristic, wherein the vibrational characteristic is a measure of a vibration damping effect in the at least a portion of the dispenser.

7. The dispenser of claim 1 comprising an outer case at least partially enclosing the product storage area and wherein the vibration sensing device is coupled to the outer case.

8. The dispenser of claim 7 comprising an isolator coupled to the outer case and configured to provide vibration isolation between the dispenser and a wall on which the dispenser is mounted.

9. The dispenser of claim 1, wherein the data processing device comprises a wireless transmitter.

10. A dispenser for dispensing consumable product comprising:

a consumable product storage area configured to store the consumable product within the dispenser;

a dispensing mechanism operatively coupled to the consumable product and configured to facilitate a dispensing cycle to dispense a portion of consumable product, and wherein the dispensing cycle creates a vibration event in at least a portion of the dispenser;

a vibration sensing device configured to sense a vibrational characteristic of the vibration event, wherein a value of the vibrational characteristic changes as a function of an amount of consumable product remaining in the dispenser; and a data processing device configured to store data describing the vibrational characteristic, wherein the vibrational characteristic changes as a linear function of the amount of consumable product remaining.

* * * * *